US010746173B2

(12) United States Patent
Jung

(10) Patent No.: US 10,746,173 B2
(45) Date of Patent: Aug. 18, 2020

(54) TWO-STAGE VARIABLE-DISPLACEMENT OIL PUMP

(71) Applicant: MYUNGHWA IND. CO., LTD., Seoul (KR)

(72) Inventor: Hyuneu Jung, Hwaseong-si (KR)

(73) Assignee: MYUNGHWA IND. CO., LTD., Seoul (KR)

( * ) Notice: Subject to any disclaimer, the term of this patent is extended or adjusted under 35 U.S.C. 154(b) by 366 days.

(21) Appl. No.: 15/832,781

(22) Filed: Dec. 6, 2017

(65) Prior Publication Data

US 2019/0120227 A1 Apr. 25, 2019

(30) Foreign Application Priority Data

Oct. 20, 2017 (KR) ..... 10-2017-0136228

(51) Int. Cl.

| | |
|---|---|
| ***F04C 2/344*** | (2006.01) |
| ***F04C 14/22*** | (2006.01) |
| ***F04C 14/24*** | (2006.01) |
| ***F01L 1/344*** | (2006.01) |

(52) U.S. Cl.

CPC ..... *F04C 14/24* (2013.01); *F04C 2/3441* (2013.01); *F04C 14/223* (2013.01); *F04C 14/226* (2013.01); *F04C 2210/206* (2013.01); *F04C 2240/10* (2013.01); *F04C 2240/20* (2013.01); *F04C 2240/30* (2013.01); *F04C 2240/811* (2013.01); *F04C 2270/052* (2013.01); *F04C 2270/18* (2013.01); *F04C 2270/185* (2013.01)

(58) Field of Classification Search

CPC ..... F04C 14/24; F04C 2/3441; F04C 14/223; F04C 14/226; F04C 2/3442; F01L 1/3442

See application file for complete search history.

(56) References Cited

U.S. PATENT DOCUMENTS 5,775,881 A * 7/1998 Stich ..... F01M 1/12 417/287

2014/0219847 A1* 8/2014 Watanabe ..... F04C 2/3442 418/24

FOREIGN PATENT DOCUMENTS

KR 10-1509994 B1 4/2015

* cited by examiner

*Primary Examiner* — Deming Wan

(74) *Attorney, Agent, or Firm* — Novick, Kim & Lee, PLLC; Jae Youn Kim; Jihun Kim

(57) ABSTRACT

A two-stage variable-displacement oil pump includes a casing having a suction port for suctioning oil stored in an oil tank and a discharge port for discharging, to a main gallery; an outer cam ring rotatably installed with respect to a pivot shaft provided inside the casing and having a rotary chamber therein; a rotor installed to be eccentric relative to the outer cam ring, rotating in concert with a rotation of a driving shaft, and including a plurality of vanes radially and slidably installed on an outer circumferential surface of the rotor; a support spring having one end contacting a spring support part formed on an outer side surface of the cam ring and the other end contacting an inner side surface of the casing; and a regulating chamber provided between the outer cam ring and the casing.

8 Claims, 14 Drawing Sheets

【FIG.1】
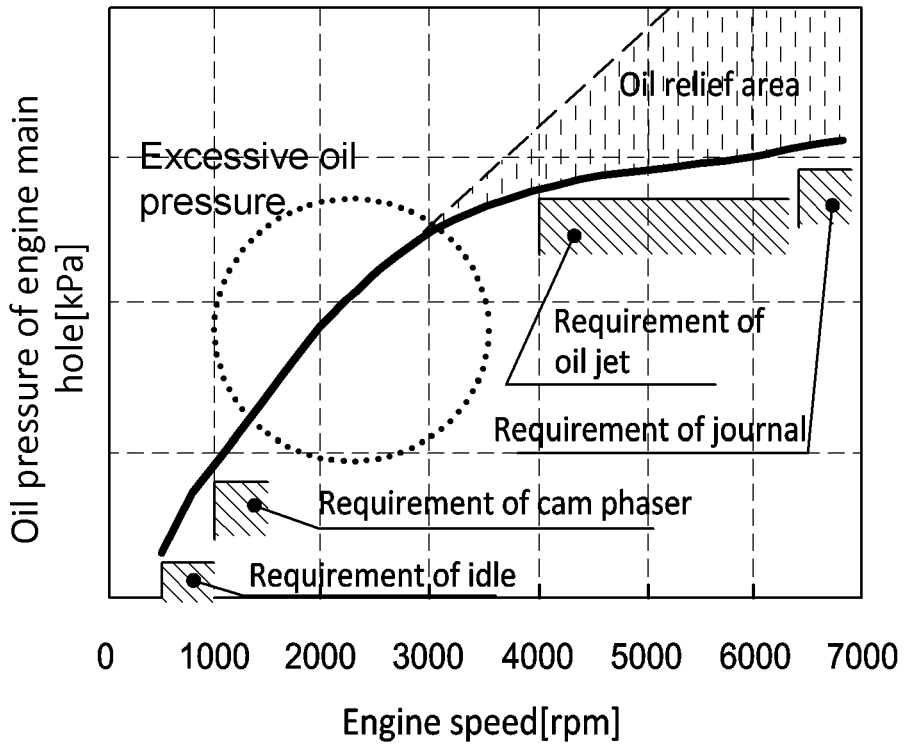

【FIG.2】
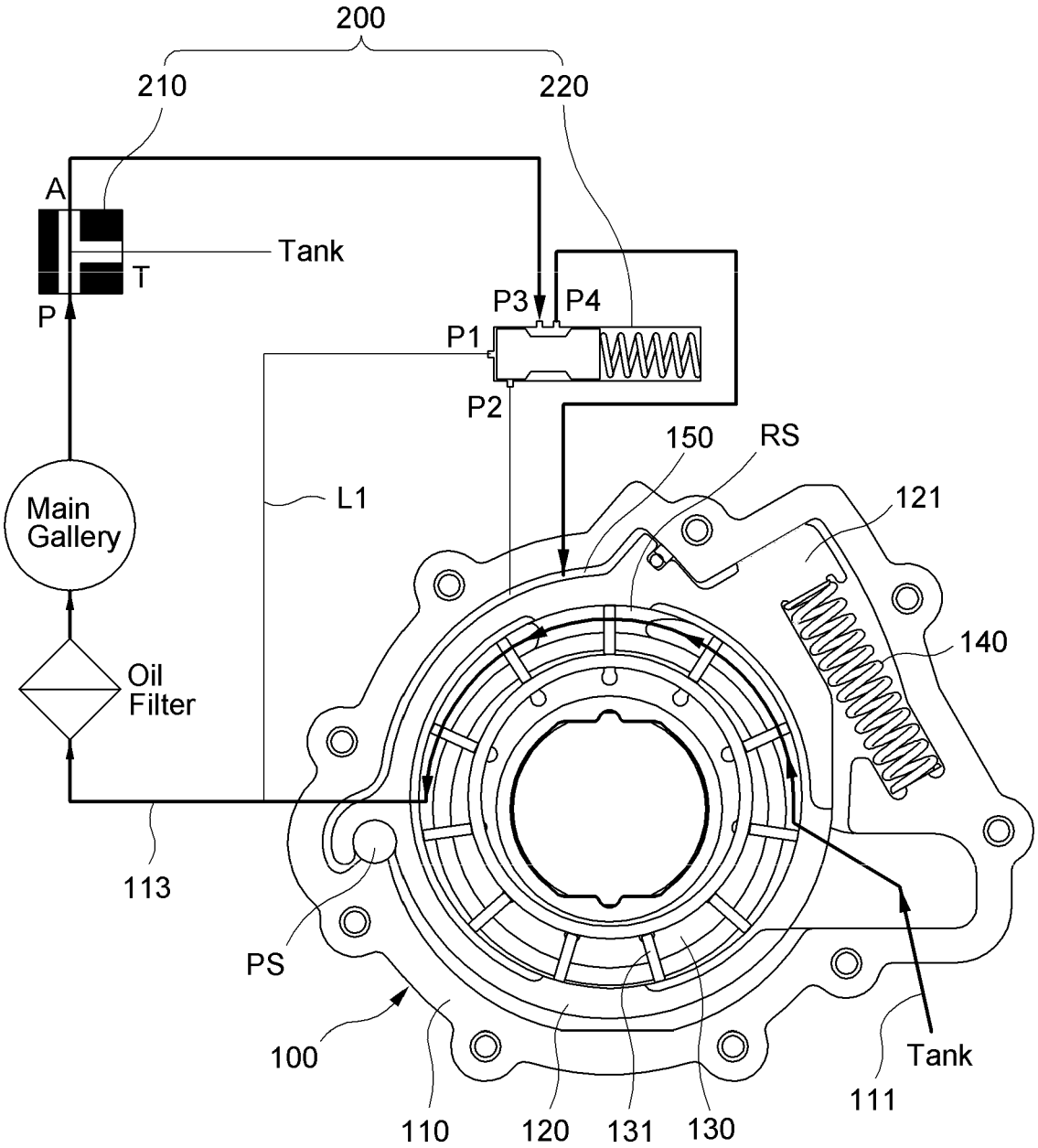

【FIG.3】
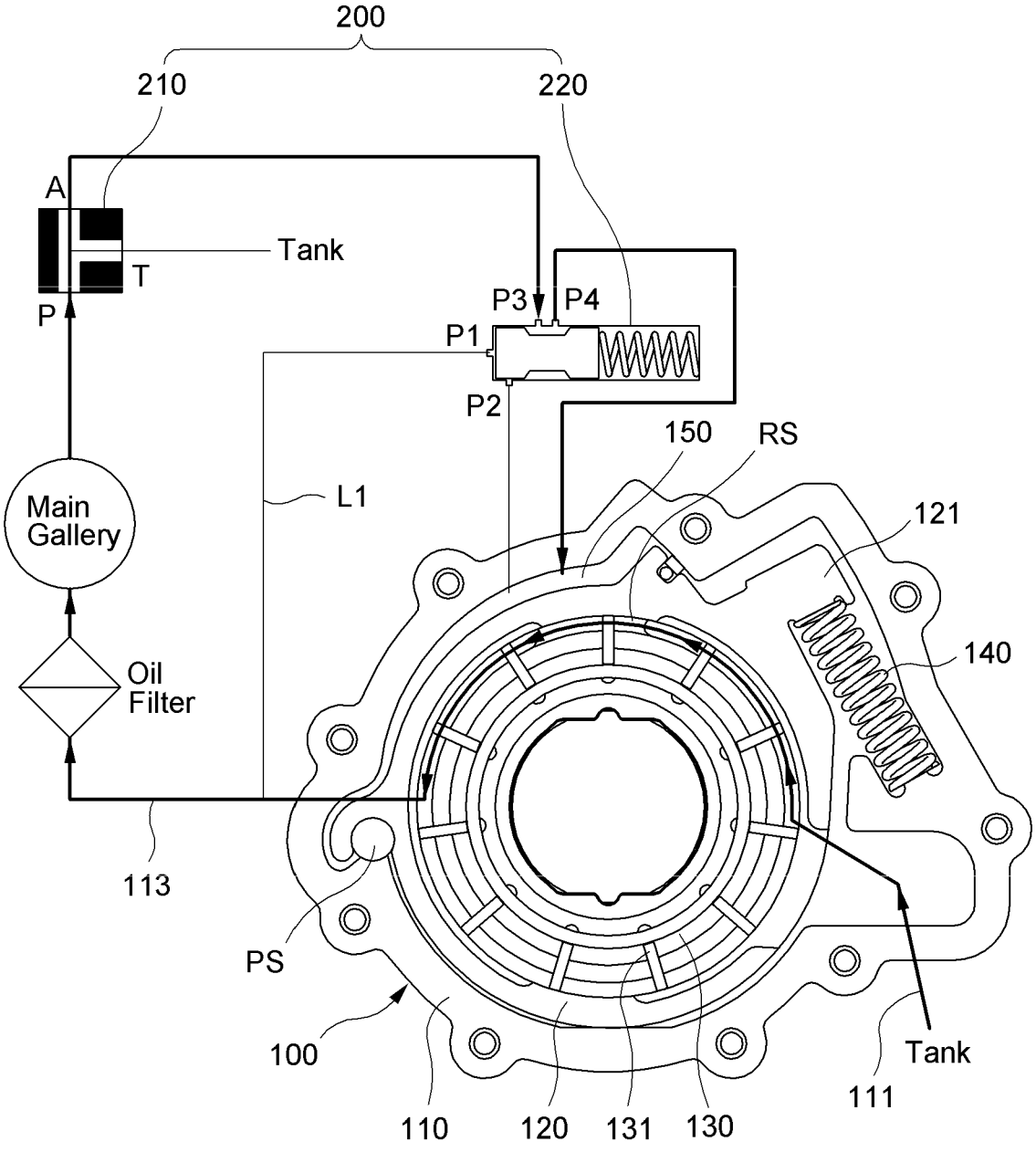

【FIG.4】
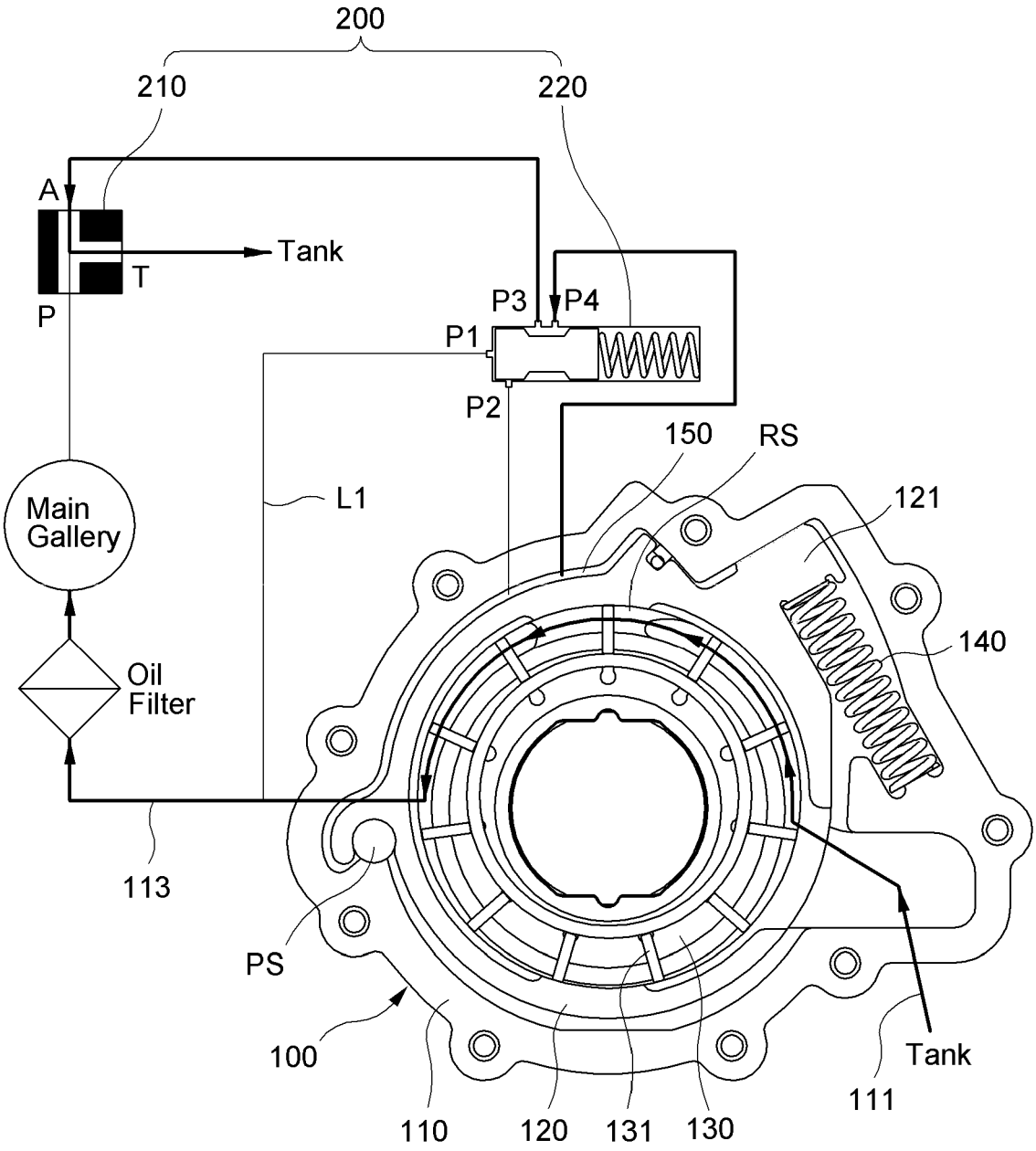

【FIG.5】
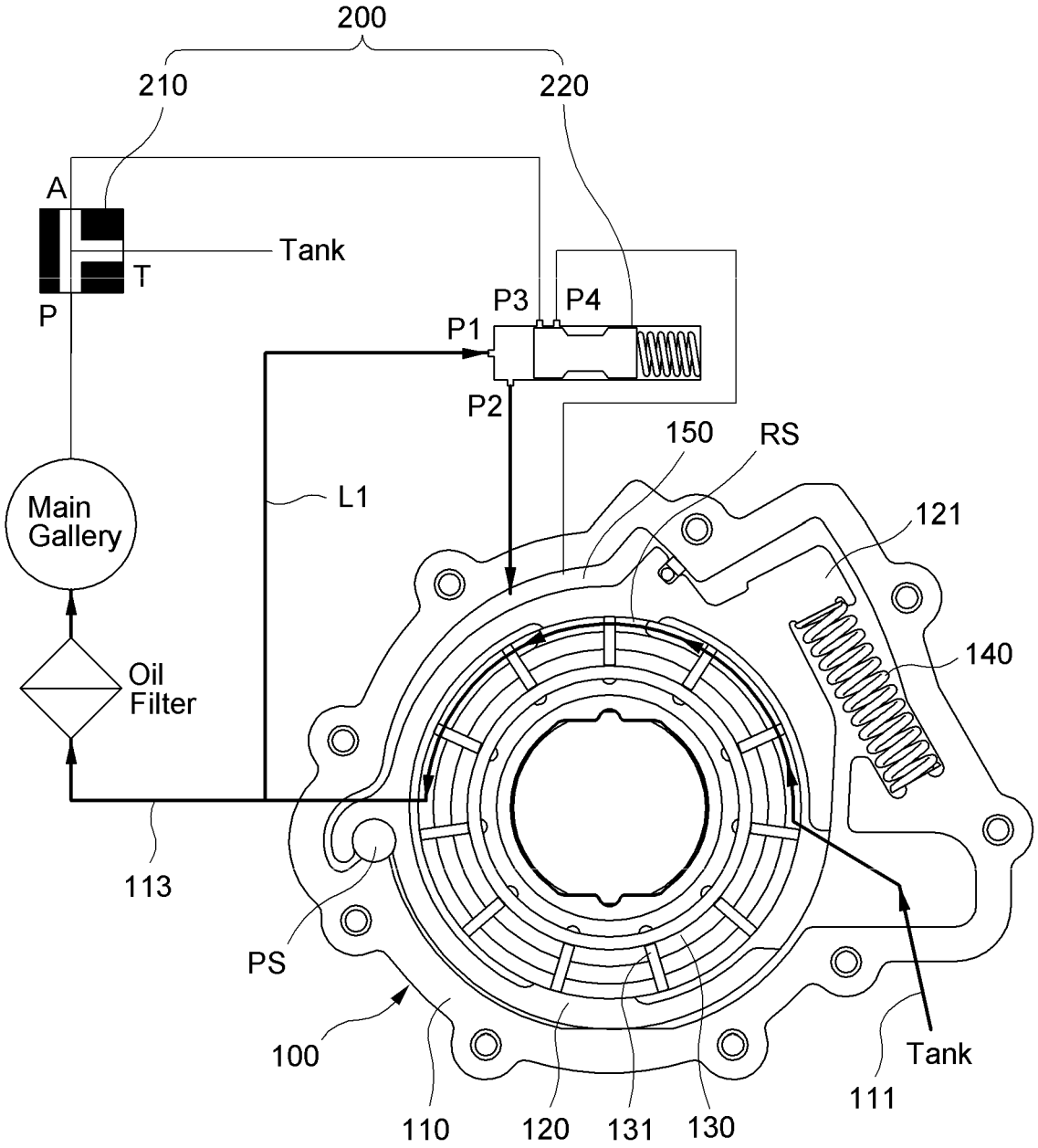

【FIG.6】
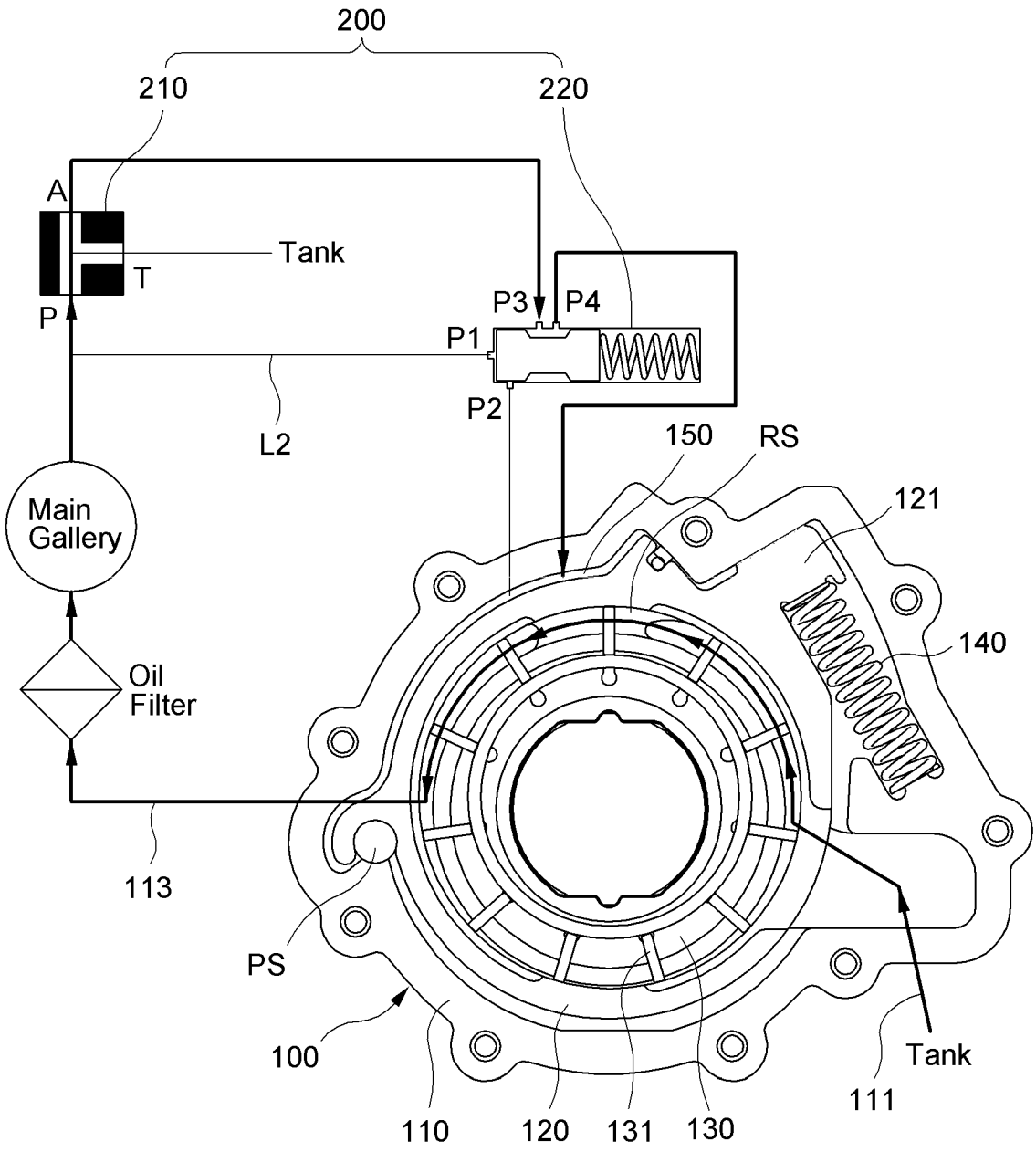

【FIG.7】
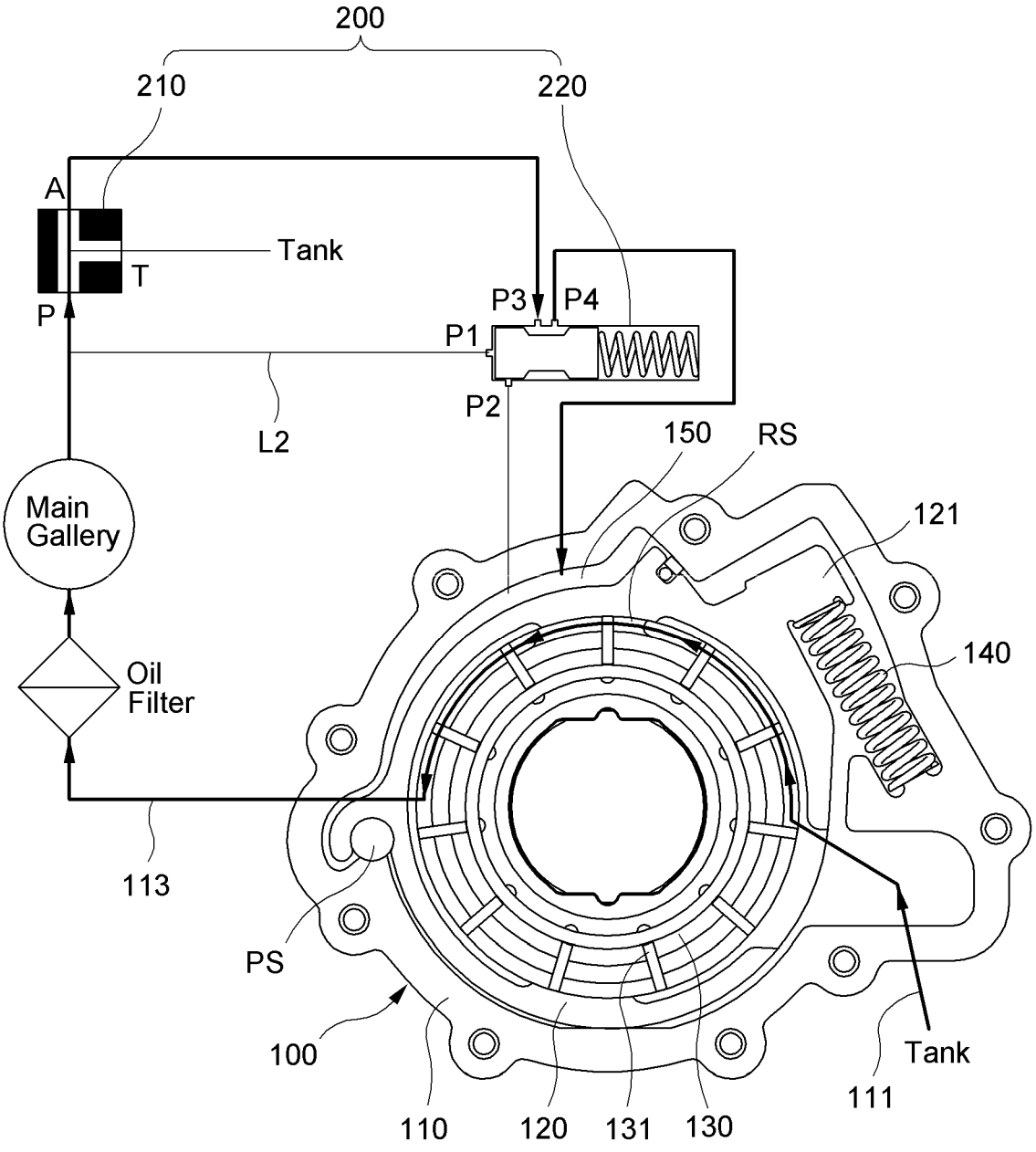

【FIG.8】
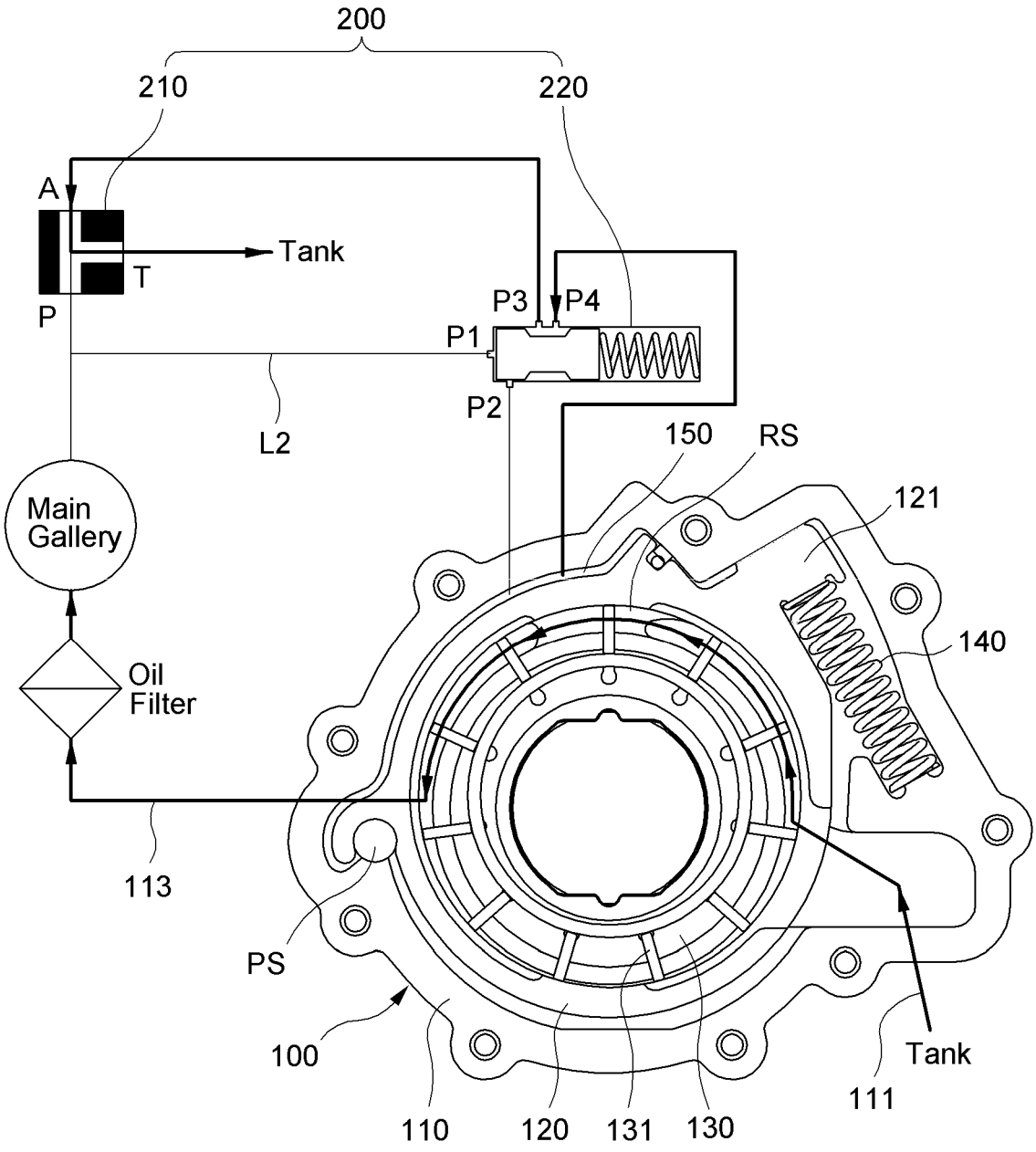

【FIG.9】
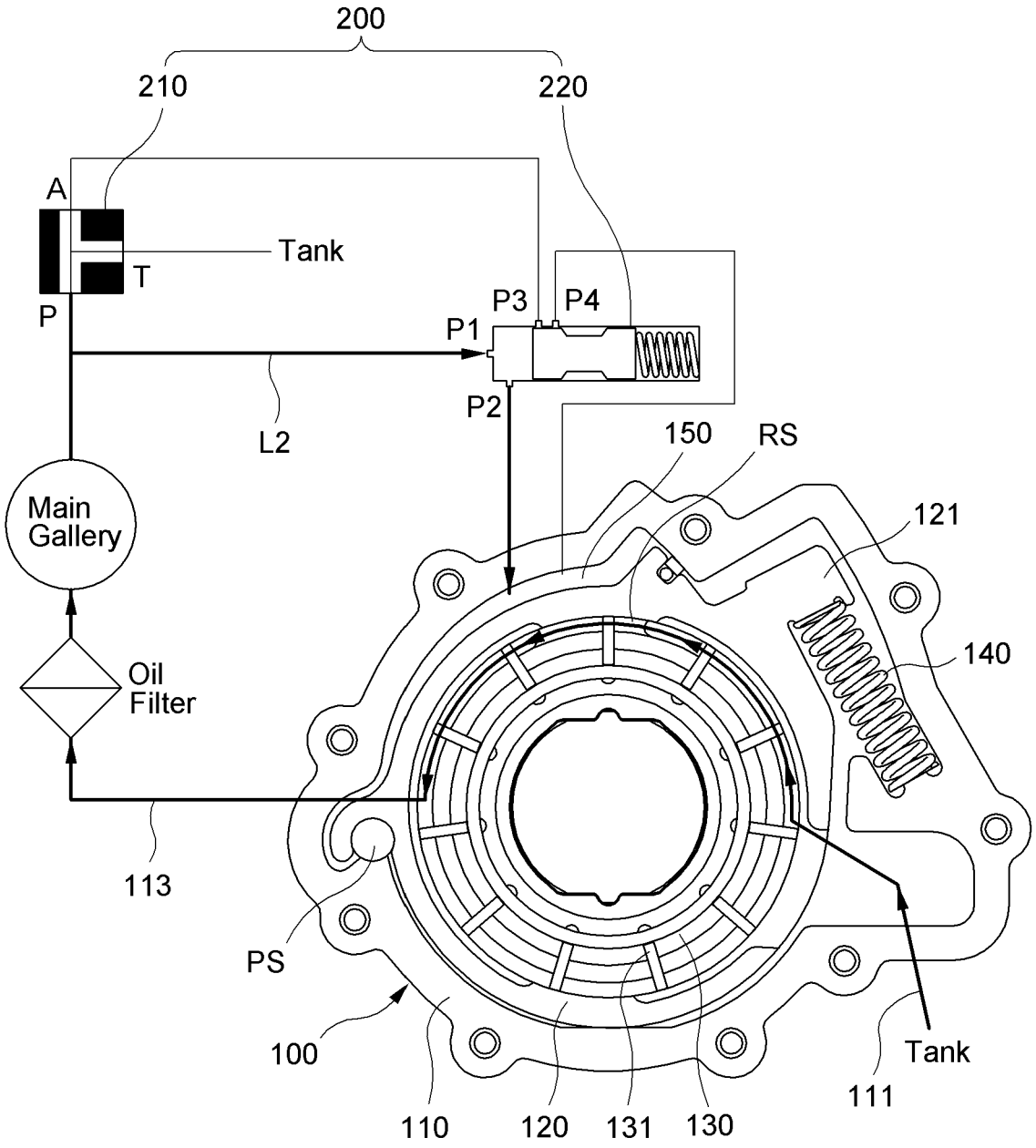

【FIG.10】
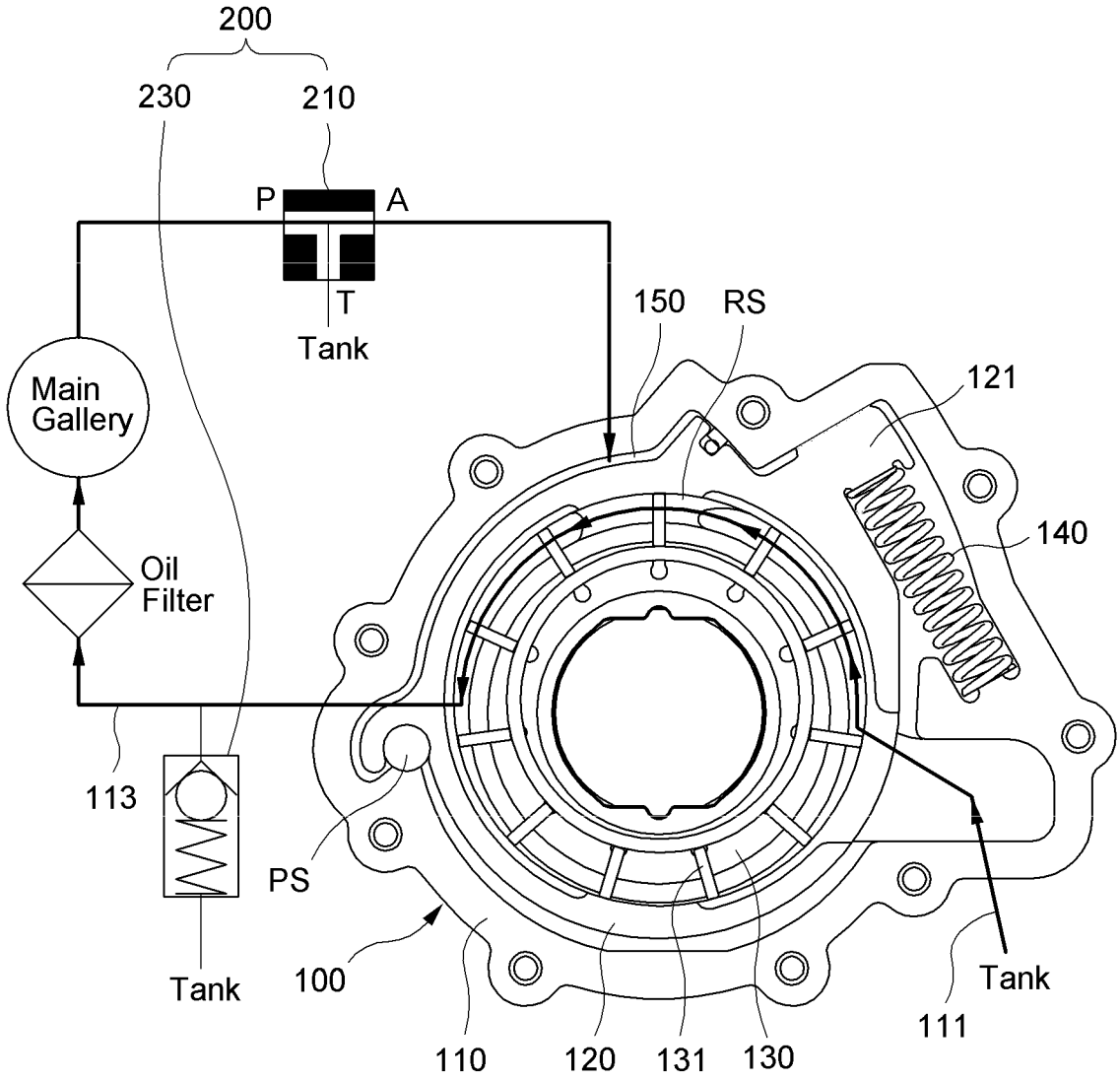

【FIG.11】
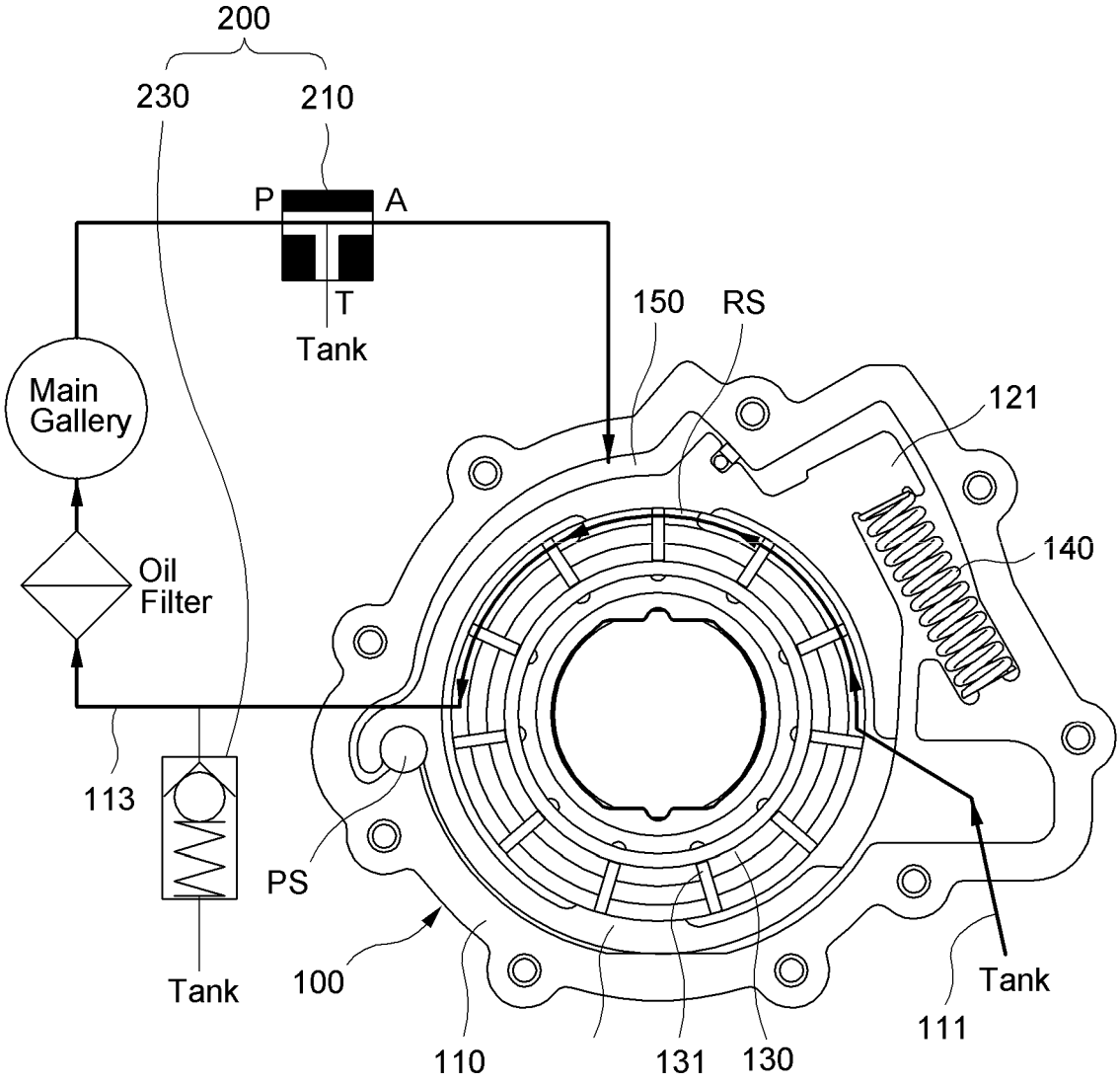

【FIG.12】
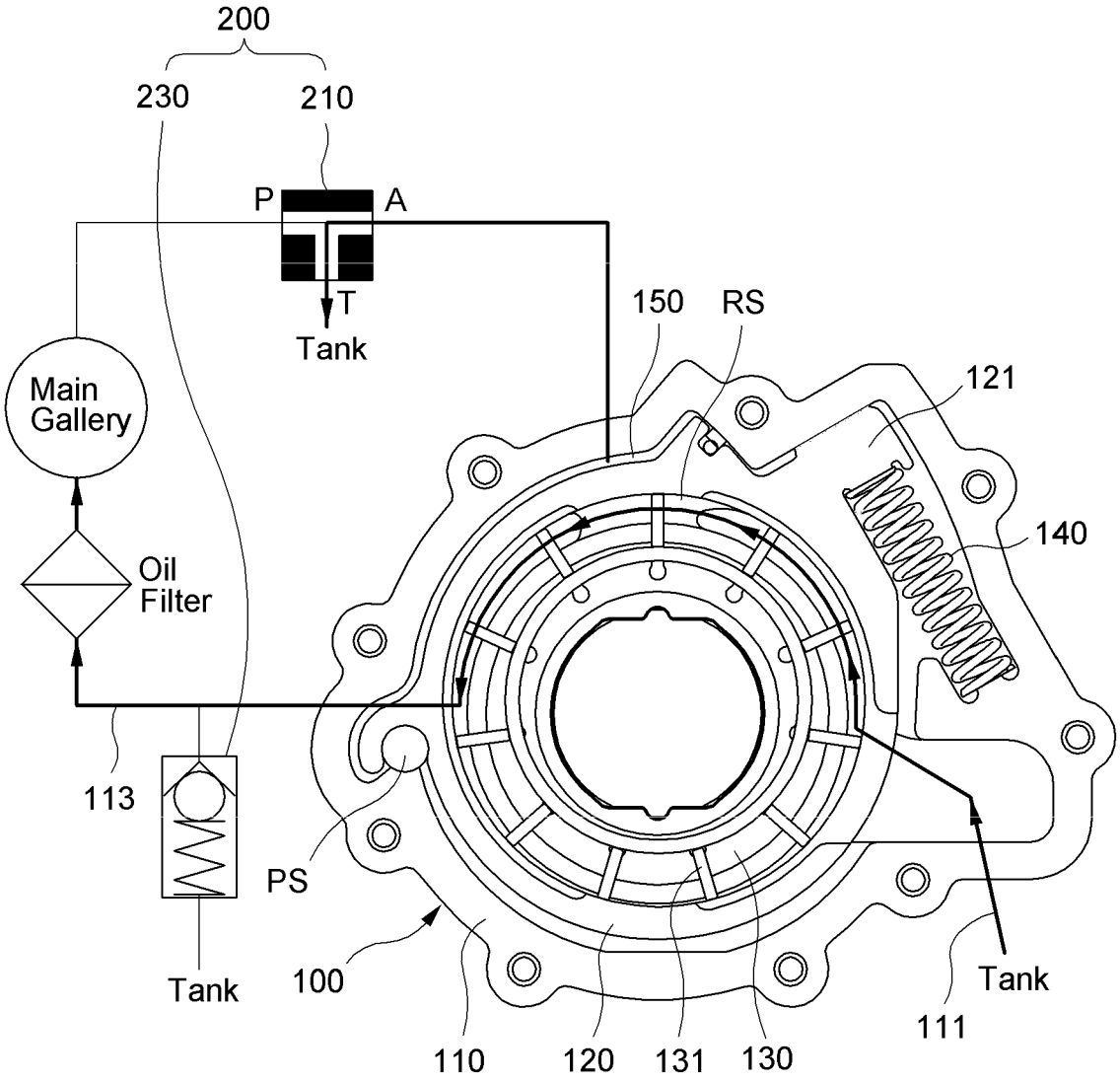

【FIG.13】
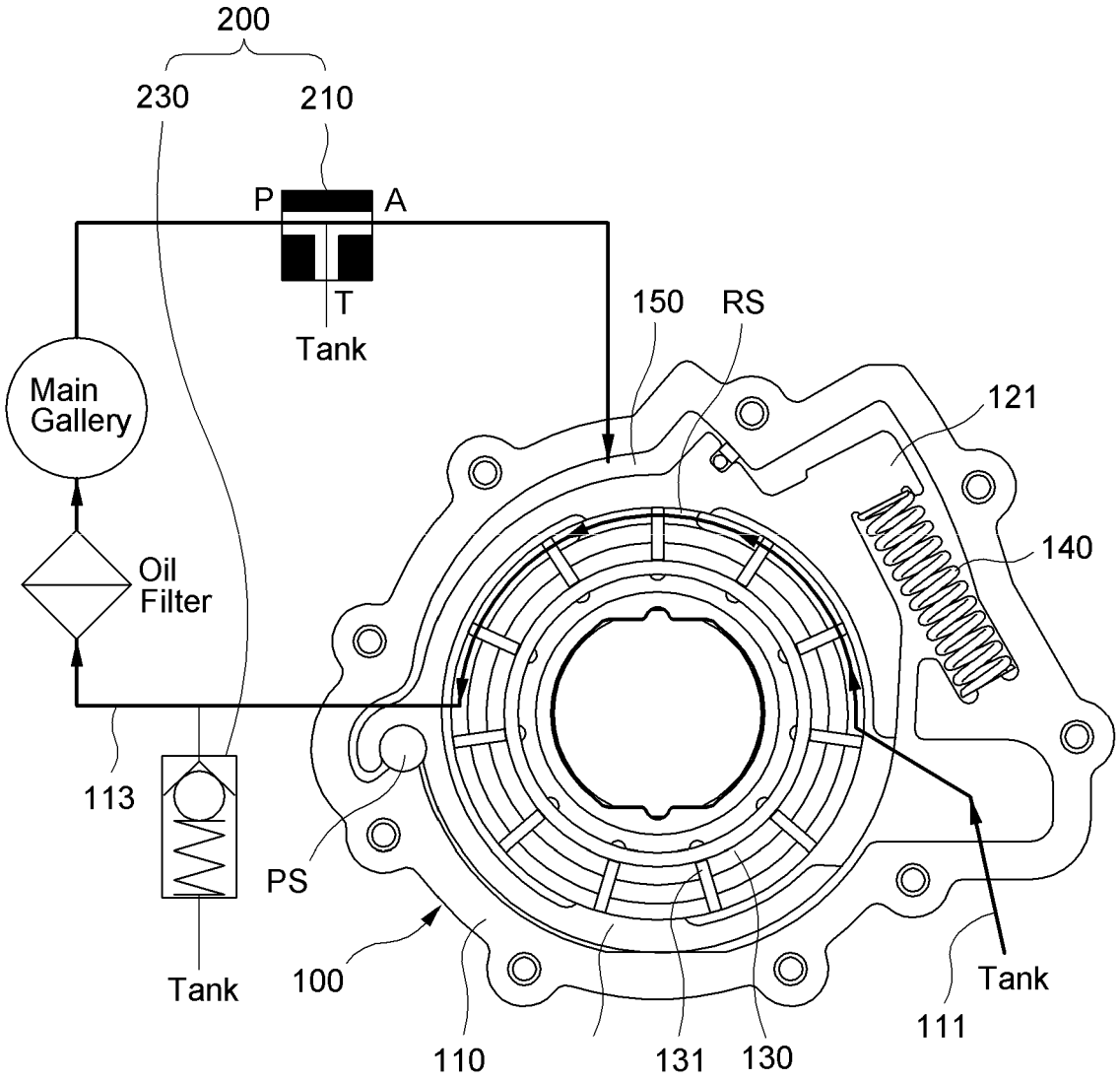

【FIG.14】
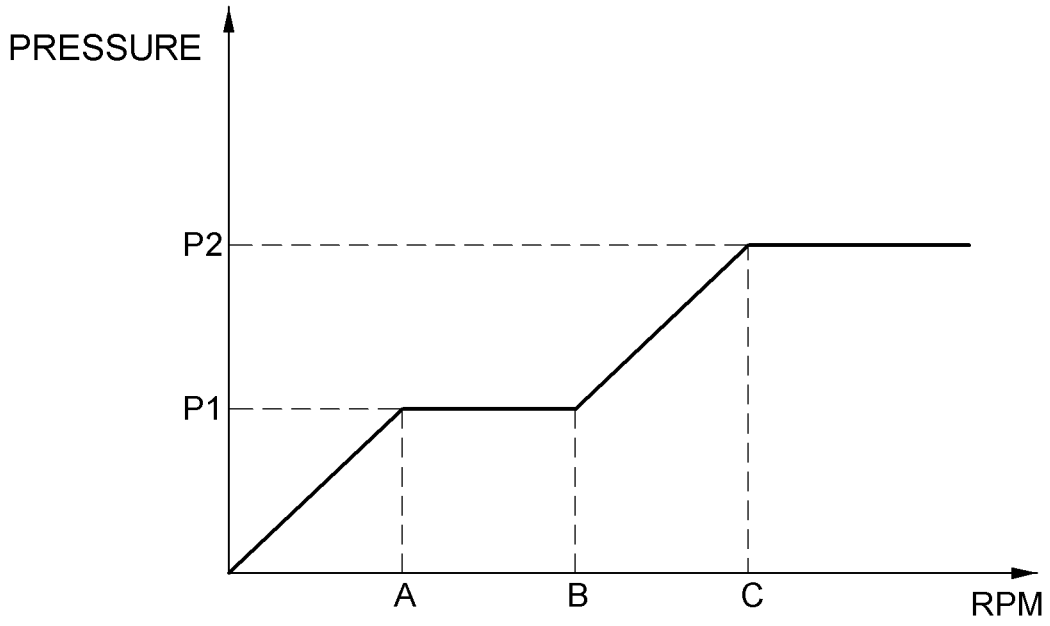

TWO-STAGE VARIABLE-DISPLACEMENT OIL PUMP

TECHNICAL FIELD

The present invention relates to a two-stage variable-displacement oil pump, and more particularly, to a two-stage variable-displacement oil pump capable of performing a two-stage pressure adjustment while having a simple structure.

BACKGROUND ART

In general, in vehicle engines, engine overheating or reduction of friction between various mechanisms may be prevented by circulating an engine oil, and to this end, an oil pump is adopted.

However, the oil pump is operated so as to discharge an oil flow toward a discharge side and suction an oil flow returned toward a suction side, and thus, when the oil pump is in operation, the driving torque of an engine cannot help being lost.

In vehicles, improvement of engine driving torque is an indispensable condition for improving fuel efficiency. Therefore, the driving torque loss which is horsepower consumed to deliver oil due to an oil pump and is proportional to the product of flow rate and oil pressure of the oil pump can be reduced by improving the performance of the oil pump.

Recently, the importance of saving fuel in vehicles have further been growing due to global high price of oil and carbon dioxide restriction, and thus, in development of vehicles, improvement of fuel efficiency and environment friendliness have been considered as a core issue.

In particular, considering that the improvement of engine driving torque is indispensable for improvement of fuel efficiency, reduction of driving torque loss due to an oil pump may be very effective for improvement of fuel efficiency.

For example, as illustrated in FIG. 1, a structure for improving fuel efficiency by bypassing a portion of oil through a relief valve at a high rpm and thereby lowering the pressure of oil has been disclosed.

However, the oil pump as described above might alleviate oil pressure within a high-speed range, but the oil pressure in a middle-speed range was still maintained high, and therefore, there was a limitation of decreasing the efficiency of improving fuel consumption.

[Related Art Document]

Korean Patent No. 10-1509994 (Registered on Apr. 1, 2015)

SUMMARY

An objective of the present invention for solving the limitations of the related art is to provide a two-stage variable displacement oil pump capable of performing a two-stage pressure adjustment while having a simple structure.

A two-stage variable-displacement oil pump for solving the above-mentioned limitations in accordance with an exemplary embodiment of the present invention includes a pumping part and a path setting part, the pumping part comprising: a casing having a suction port for suctioning oil stored in an oil tank and a discharge port for discharging, to a main gallery, the oil suctioned into the suction port; an outer cam ring rotatably installed with respect to a pivot shaft provided inside the casing and having a rotary chamber therein; a rotor installed to be eccentric relative to the outer cam ring, rotating in concert with a rotation of a driving shaft, and including a plurality of vanes radially and slidably installed on an outer circumferential surface of the rotor; a support spring having one end contacting a spring support part formed on an outer side surface of the cam ring and the other end contacting an inner side surface of the casing, and thereby elastically supporting the outer cam ring; and a regulating chamber provided between the outer cam ring and the casing and configured to change a degree of eccentricity of the outer cam ring, the path setting part setting a circulating path of oil so that the oil discharged from a discharge port is supplied to the regulating chamber or returned to the oil tank.

In an embodiment, a control unit may control a pressure of the oil: to increase in proportion to an rpm of the rotor when the rpm of the rotor is less than a first rpm; to be maintained at a first pressure when the rpm of the rotor is greater than or equal to the first rpm and less than a second rpm; to increase in proportion to the rpm of the rotor when the rpm of the rotor is greater than or equal to the second rpm and less than a third rpm; and to be maintained at a second pressure when the rpm of the rotor is greater than or equal to the third rpm.

In an embodiment, the path setting part may include: a 3/2-way valve provided with: an intake port into which an oil discharged from the discharge port and circulated through the main gallery is introduced; a discharge port which supplies the oil introduced into the intake port to a downstream stage; and a tank port which return the oil introduced into the intake port to the tank, and configured to connect the intake port and the discharge port or connect the intake port and the tank port; and a spool valve provided with: a first port into which oil discharged from the discharge port and not yet circulated through the main gallery is introduced; a second port which supplies the oil introduced into the first port to the regulating chamber; a third port connected to the discharge port; and a fourth port connected to the third port, the spool valve connecting the first port and the second port or connects the third port and the fourth port.

In an embodiment, the path setting part may include: a 3/2-way valve provided with: an intake port into which an oil discharged from the discharge port and circulated through the main gallery is introduced; a discharge port which supplies the oil introduced into the intake port to the downstream stage; and a tank port which return the oil introduced into the intake port to the tank, and configured to connect the intake port and the discharge port or connect the intake port and the tank port; and a spool valve provided with: a first port into which oil discharged from the discharge port and circulated through the main gallery is introduced; a second port which supplies the oil introduced into the first port to the regulating chamber; a third port connected to the discharge port; and a fourth port connected to the third port, the spool valve connecting the first port and the second port or connects the third port and the fourth port.

the control part may control the intake port and the discharge port of the 3/2-way valve to be connected when the rpm of the rotor is less than the second rpm, and control the discharge port and the tank port of the 3/2-way valve to be connected when the rpm of the rotor is greater than or equal to the second rpm and less than the third rpm; and the spool vale may operate so as to block a connection between the first port and the second port and to connect the third port and the fourth port when the rpm of the rotor is less than the third rpm, and to connect the first port and the second port and block a connection between the third port and the fourth port when the rpm of the rotor is greater than or equal to the third rpm.

In an embodiment, the path setting part may include: a 3/2-way valve provided with: an intake port into which the oil discharged from the discharge port and circulated through the main gallery is introduced; a discharge port which supplies the oil introduced into the intake port to the regulating chamber; and a tank port which return the oil introduced into the intake port to the tank, the 3/2-way valve connecting the intake port and the discharge port or connecting the intake port and the tank port.

In an embodiment, the control part may control the intake port and the discharge port of the 3/2-way valve to be connected when the rpm of the rotor is less than the second rpm, control the intake port and the tank port of the 3/2-way valve to be connected when the rpm of the rotor is greater than or equal to the second rpm and less than the third rpm, and control the intake port and the discharge port of the 3/2-way valve to be connected when the rpm of the rotor is greater than or equal to the third rpm.

In an embodiment, the path setting part may include a check valve provided between the pumping part and the main gallery.

BRIEF DESCRIPTION OF THE DRAWINGS

Exemplary embodiments can be understood in more detail from the following description taken in conjunction with the accompanying drawings, in which:

FIG. 1 is a graph illustrating a pressure change due to an operation of a conventional pump system;

FIG. 2 is a configuration diagram illustrating an operational state in a first interval of a two-stage variable-displacement oil pump in accordance with a first example of the present invention;

FIG. 3 is a configuration diagram illustrating an operational state in a second interval of a two-stage variable-displacement oil pump in accordance with a first example of the present invention;

FIG. 4 is a configuration diagram illustrating an operational state in a third interval of a two-stage variable-displacement oil pump in accordance with a first example of the present invention;

FIG. 5 is a configuration diagram illustrating an operational state in a fourth interval of a two-stage variable-displacement oil pump in accordance with a first example of the present invention;

FIG. 6 is a configuration diagram illustrating an operational state in a first interval of a two-stage variable-displacement oil pump in accordance with a second example of the present invention;

FIG. 7 is a configuration diagram illustrating an operational state in a second interval of a two-stage variable-displacement oil pump in accordance with a second example of the present invention;

FIG. 8 is a configuration diagram illustrating an operational state in a third interval of a two-stage variable-displacement oil pump in accordance with a second example of the present invention;

FIG. 9 is a configuration diagram illustrating an operational state in a fourth interval of a two-stage variable-displacement oil pump in accordance with a second example of the present invention;

FIG. 10 is a configuration diagram illustrating an operational state in a first interval of a two-stage variable-displacement oil pump in accordance with a third example of the present invention;

FIG. 11 is a configuration diagram illustrating an operational state in a second interval of a two-stage variable-displacement oil pump in accordance with a third example of the present invention;

FIG. 12 is a configuration diagram illustrating an operational state in a third interval of a two-stage variable-displacement oil pump in accordance with a third example of the present invention;

FIG. 13 is a configuration diagram illustrating an operational state in a fourth interval of a two-stage variable-displacement oil pump in accordance with a third example of the present invention; and FIG. 14 is a graph illustrating pressure changes in first to fourth intervals of a two-stage variable-displacement oil pump in accordance with an example of the present invention.

DETAILED DESCRIPTION OF EMBODIMENTS

The present invention may be implemented in various forms without departing form technical concepts and main features thereof. Thus, embodiments of the present invention are, in all aspects, merely simple exemplary examples, and should not be limitatively interpreted.

The terms such as "first" and "second" may be used to describe various components, but the components should not be limited by the terms.

The terms are used only for the purpose of discriminating one component from other components. For example, a first component may be named as a second component within the scope of the present disclosure, and likewise, the second component may be named as the first component.

The term "and/or" includes a combination of a plurality of related elements described or one among a plurality of the related elements described.

When a component is referred to as being "coupled" or "connected" to another component, the component may be directly coupled or connected to the another component, but another component may be present therebetween.

Conversely, when a component is referred to as being "directly coupled" or "connected" to another component, it should be understood that other component is not present therebetween.

The terms used in the present disclosure are used to describe only a specific embodiment, and are not used to limit the present disclosure. Singular representation includes plural representation unless otherwise noted clearly different in context.

In the present application, it should be understood that the terms such as "include", "comprise", and "have" are used to designate the presence of a feature, a number, a step, an operation, a component, or combinations thereof, but not to in advance exclude the possibility of the presence or addition of one or more of other features, numbers, steps, operations, components or combinations thereof.

Unless otherwise defined, all terms including technical or scientific terms used herein have the same meanings generally understood by a person skilled in the art belonging to the present invention.

Terms such as those defined in generally used dictionaries should be understood to have meaning coinciding with a meaning related technique has in context, and should not be understood as an ideal, excessively formal meaning unless otherwise clearly defined in the present application.

Hereinafter, with reference to accompanying drawings, preferred exemplary embodiments according to the present invention will be described in detail, like reference numeral is applied to like components which are the same as or corresponding to each other, and the overlapping descriptions thereon will not be provided.

In describing the present invention, when a detailed description about a related well-known art may obscure the gist of the present invention, the detailed description thereof will not be provided.

First Embodiment

FIG. 2 is a configuration diagram illustrating an operational state in a first interval of a two-stage variable-displacement oil pump in accordance with a first embodiment of the present invention, FIG. 3 is a configuration diagram illustrating an operational state in a second interval of a two-stage variable-displacement oil pump in accordance with a first embodiment of the present invention, FIG. 4 is a configuration diagram illustrating an operational state in a first interval of a two-stage variable-displacement oil pump in accordance with a first embodiment of the present invention, and FIG. 5 is a configuration diagram illustrating an operational state in a fourth interval of a two-stage variable-displacement oil pump in accordance with a first embodiment of the present invention.

As illustrated in FIGS. 2 to 5, a two-stage variable-displacement oil pump in accordance with a first embodiment of the present invention is configured to include a pumping part 100 and a path setting part 200.

The pumping part 100 is a part in which pumping is carried out to discharge and deliver oil to a main gallery and the like.

Specifically, the pumping part 100 is configured to include a casing 110, an outer cam ring 120, vanes 131, a rotor 130, a support spring 14 and the like, and has therein a rotary chamber RS and a regulating chamber 150.

The casing 110 is provided with a suction port 111 for suctioning oil stored in an oil tank and a discharge port 113 for discharging the oil suctioned into the suction port 111 to the main gallery.

The outer cam ring 120 is rotatably installed with respect to a pivot shaft PS provided inside the casing 110.

The rotor 130 is installed to be eccentric relative to the outer cam ring 120, rotates in concert with a rotation of a driving shaft, and includes a plurality of vanes 131 which are radially and slidably coupled to an outer circumferential surface thereof.

Due to the rotation of the rotor 130, the vanes 131 rotate in radially pushed-out states, and oil in the oil tank is suctioned into the rotary chamber RS by a suctioning force generated in the suctioning port 111 and then discharged toward the discharge port 113.

One end of the support spring 140 contacts a spring support part 121 formed on an outer side surface of the outer cam ring 120, and the other end of the support spring 140 contacts an inner side surface of the casing 110 and elastically support the outer cam ring 120.

Accordingly, as illustrated in FIG. 2, in the state in which the support spring 140 is extended, the outer cam ring 120 and the rotor 130 are in eccentric states, and as illustrated in FIG. 4, in the state which the support spring 140 is contracted, the outer cam ring 120 and the rotor 130 are in nearly concentric states.

The regulating member 150 which is formed between the outer cam ring 120 and the casing 110 and changes a degree of eccentricity of the outer cam ring 120 is provided. According to the pressure in the regulating chamber 150, the support spring 140 is extended or contracted.

The path setting part 200 is a part for setting a circulating path of oil so as to allow the oil discharged from the discharge port 113 formed in the casing 110 of the pumping part 100 to be supplied to the regulating chamber 150 or to be returned to the oil tank.

The path setting part 200 is configured to include a 3/2-way valve 210 and a spool valve 220.

The 3/2-way valve 210 is a directional control valve provided with an intake port P, discharge port A, and a tank port T, and further provided with two flow passages.

Specifically, the 3/2 way valve 210 is provided with an intake port P into which the oil discharged from the discharge port 113 and circulated via the main gallery is introduced, a discharge port A for supplying the oil introduced into the intake port P to a downstream stage, and a tank port T for returning the oil introduced into the intake port P to the tank, and further provided with two flow passages which connect the intake port P with the discharge port A or connect the intake port P with the tank port T.

For example, in the case of being electrically turned on, the 3/2 way valve 210 is operated so that the intake port P and the discharge port A are connected, and a path in which a fluid may flow only through the intake port P and the discharge port A is formed, and in the case of being electrically turned off, the 3/2 way valve 210 is operated so that the intake port P and the tank port T are connected, and a path in which a fluid may flow only through the intake port P and the tank port T is formed.

The stool valve 220 is provided with: a first port P1 into which the oil discharged from the discharge port 113 and not yet circulated through the main gallery is introduced; a second port P2 which supplies the oil introduced into the first port P1 to the regulating chamber 150; a third port P3 connected to the discharge port A; and a fourth port P4 connected to the third port P3, the spool valve 220 being configured to connect the first port P1 and the second port P2 or connect the third port P3 and the fourth port P4.

For example, the first port P1 may be formed on one end surface of the spool valve 220, the second port P2 may be formed on a side surface portion on one side of the spool valve 220, and the third and fourth ports P3 and P4 are respectively formed on positions spaced apart toward the other side from the second port P2. On one side in the spool valve 220, a spool for connecting the first port P1 and the second port P2 or connecting the third port P3 and the fourth port P4 may be provided, and on the other side in the spool valve 220, a spring may be provided.

Accordingly, when the pressure of the oil introduced into the first port P1 is less than a predetermined pressure, the spool is positioned at the one side and thus, the third port P3 and the fourth port P4 are transited in a connected state. In addition, when the pressure of the oil introduced into the first port P1 is greater than a predetermined pressure, the spool is moved to the other side and thus, the first port P1 and the second port P2 are transited in a connected state.

As described above, the operation of the two-stage variable-displacement oil pump configured to include the pumping part 100 and the path setting part 200 may be controlled by a control unit not shown.

Specifically, the control unit may control the pumping part 100 and the path setting part 200 such that: the pressure of the oil increases in proportion to the rpm of the rotor 130 when the rpm of the rotor 130 is less than a first rpm; the pressure of the oil is maintained at a first pressure P1 in FIG. 14 when the rpm of the rotor 130 is greater than or equal to the first rpm and less than a second rpm; the pressure of the oil increases in proportion to the rpm of the rotor 130 when the rpm of the rotor 130 is greater than or equal to the second rpm and less than a third rpm; and the pressure of the oil is maintained at a second pressure P2 in FIG. 14 when the rpm of the rotor 130 is greater than the third rpm.

To this end, the control unit controls the intake port P and the discharge port A of the 3/2-way valve 210 to be connected when the rpm of the rotor 130 is less than the second rpm, and controls the discharge port A and the tank port T of the 3/2-way valve 210 to be connected when the rpm of the rotor 130 is greater than or equal to the second rpm and less than the third rpm.

In addition, the spool valve 220 operates so as to block the connection between the first port P1 and the second port P2 and connect the third port P3 and the fourth port P4 when the rpm of the rotor 130 is less than the third rpm, and operates to connect the first port P1 and the second port P2 and block the connection between the third port P3 and the fourth port P4 when the rpm of the rotor 130 is the third rpm or faster.

The above-mentioned control process of the control unit and the operational state of the spool valve 220 will be described as follows for each interval.

First, when the rpm of the rotor 130 is greater than or equal to zero and less than the first rpm point A in FIG. 14, the control unit controls the intake port P and the discharge port A of the 3/2-way valve 210 to be connected, and the spool valve 220 operates so as to block the connection between the first port P1 and the second port P2 and to connect the third port P3 and the fourth port P4.

Accordingly, as illustrated in FIG. 2, the oil suctioned into the suction port 111 is compressed in the rotary chamber RS and discharged to the discharge port 113, and the oil discharged through the discharge port 113 is circulated through an oil filter and the main gallery, then passes through the intake port P and the discharge port A, and may then be supplied to the regulating chamber 150 through the third port P3 and the fourth port P4 of the stool valve 220.

In such a state, as illustrated in FIG. 14, the pressure of the oil increases in proportion to the rpm of the rotor 130 until the pressure in the rotary chamber RS reaches P1.

Next, also when the rpm of the rotor 130 is greater than or equal to the first rpm and less than the second rpm point B in FIG. 14, the control unit controls the intake port P and the discharge port A of the 3/2-way valve 210 to be connected, and the spool valve 220 operates so as to block the connection between the first port P1 and the second port P2 and connect the third port P3 and the fourth port P4.

At this point, as the pressure of the oil applied to the regulating chamber 150 increases, the support spring 140 is compressed, and thus, the rotor 130 and the outer cam ring 120 become nearly concentric to each other and the compression of the oil is not carried out. Therefore, the pressure of the oil does not increase and is maintained at the first pressure P1 in FIG. 14.

That is, as illustrated in FIG. 3, the oil suctioned into the suction port 111 is discharged to the discharge port 113 through the rotary chamber RS, and the oil discharged through the discharge port 113 is circulated through the oil filter and the main gallery, then passes through the intake port P and the discharge port A of the 3/2-way valve 210, and is then supplied to the regulating chamber 150 through the third port P3 and the fourth port P4 of the stool valve 220.

In such a state, the overall pressure of the oil is maintained at the first pressure P1 in FIG. 14.

Next, when the rpm of the rotor 130 is greater than or equal to the second rpm and less than the third rpm point C in FIG. 14, the control unit controls the discharge port A and the tank port T of the 3/2-way valve 210 to be connected, and the spool valve 220 operates so as to block the connection between the first port P1 and the second port P2 and connect the third port P3 and the fourth port P4.

That is, while the oil in the regulating chamber 150 returns to the tank through the third port P3 and the fourth port P4 of the spool valve 220, the oil pressure in the regulating chamber 150 is decreased, and thereby the rotor 130 and the outer cam ring 120 become eccentric to each other again.

Accordingly, as illustrated in FIG. 4, the oil suctioned from the suction port 111 is compressed in the rotary chamber RS and discharged to the discharge port 113, and the oil discharged through the discharge port 113 may be circulated through the oil filter and the main gallery.

In such a state, as illustrated in FIG. 14, the oil pressure increases in proportion to the rpm of the rotor 130 until the pressure in the rotary chamber RS reaches the second pressure.

Next, when the rpm of the rotor 130 is greater than the third rpm, the spool valve 220 operates so as to block the connection between the first port P1 and the second port P2 and connect the third port P3 and the fourth port P4.

At this point, as the pressure of the oil applied to the regulating chamber 150 increases, the support spring 140 is compressed, and thus, the rotor 130 and the outer cam ring 120 become nearly concentric to each other and the compression of the oil is not carried out. Therefore, the pressure of the oil does not increase and is maintained at the second pressure P2 in FIG. 14.

That is, as illustrated in FIG. 5, the oil suctioned from the suction port 111 is discharged to the discharge port 113 through the rotary chamber RS, and the oil discharged through the discharge port 113 may be circulated through the oil filter and the main gallery. In addition, in this state, a portion of the oil discharged through the discharge port 113 is introduced to the first port P1 of the spool valve 220 through a first separate line L1 and is then discharged through the second port P2 to be supplied to the regulating chamber 150.

In such a state, the overall pressure of the oil is maintained at the second pressure P2 in FIG. 14.

Second Embodiment

FIG. 6 is a configuration diagram illustrating an operational state in a first interval of a two-stage variable-displacement oil pump in accordance with a second embodiment of the present invention, FIG. 7 is a configuration diagram illustrating an operational state in a second interval of a two-stage variable-displacement oil pump in accordance with a second embodiment of the present invention, FIG. 8 is a configuration diagram illustrating an operational state in a third interval of a two-stage variable-displacement oil pump in accordance with a second embodiment of the present invention, and FIG. 9 is a configuration diagram illustrating an operational state in a fourth interval of a two-stage variable-displacement oil pump in accordance with a second embodiment of the present invention.

As illustrated in FIGS. 6 to 9, a two-stage variable-displacement oil pump in accordance with a second embodiment of the present invention is configured to include a pumping part 100 and a path setting part 200.

The pumping part 100 is a part, in which pumping is carried out to discharge and deliver oil to a main gallery or the like, and is the same as the pumping part 100 of the first embodiment. Therefore, detailed description thereof will not be provided.

The path setting part 200 is configured to include a 3/2-way valve 210 and a spool valve 220 which have the same configuration as in the first embodiment, and only the connection relation between the ports of the spool valve 220 is different.

Specifically, the stool valve 220 is provided with: a first port P1 into which the oil discharged from a discharge port 113 and then circulated through the main gallery is introduced through a second branch line L2; a second port P2 which supplies the oil introduced into the first port P1 to a regulating chamber 150; a third port P3 connected to a discharge port A; and a fourth port P4 connected to the third port P3, the stool valve 220 being configured to connect the first port P1 and the second port P2 or connect the third port P3 and the fourth port P4.

As described above, the operation of the two-stage variable-displacement oil pump configured to include the pumping part 100 and the path setting part 200 may be controlled by a control unit.

Specifically, the control unit may control the pumping part 100 and the path setting part 200 such that: the pressure of the oil increases in proportion to the rpm of the rotor 130 when the rpm of the rotor 130 is less than a first rpm; the pressure of the oil is maintained at a first pressure P1 in FIG. 14 when the rpm of the rotor 130 is greater than or equal to the first rpm and less than a second rpm; the pressure of the oil increases in proportion to the rpm of the rotor 130 when the rpm of the rotor 130 is greater than or equal to the second rpm and less than a third rpm; and the pressure of the oil is maintained at a second pressure P2 in FIG. 14 when the rpm of the rotor 130 is greater than or equal to the third rpm.

To this end, the control unit controls the intake port P and the discharge port A of the 3/2-way valve 210 to be connected when the rpm of the rotor 130 is less than the second rpm, and controls the discharge port A and the tank port T of the 3/2-way valve 210 to be connected when the rpm of the rotor 130 is greater than or equal to the second rpm and less than the third rpm.

In addition, the spool valve 220 operates so as to block the connection between the first port P1 and the second port P2 and to connect the third port P3 and the fourth port P4 when the rpm of the rotor 130 is less than the third rpm, and operates to connect the first port P1 and the second port P2 and block the connection between the third port P3 and the fourth port P4 when the rpm of the rotor 130 is greater than or equal to the third rpm.

The above-mentioned control process of the control unit and the operational state of the spool valve 220 are the same as or similar to those in the first embodiment, and therefore, the detailed description thereof will not be provided.

Third Embodiment

FIG. 10 is a configuration diagram illustrating an operational state in a first interval of a two-stage variable-displacement oil pump in accordance with a third embodiment of the present invention, FIG. 11 is a configuration diagram illustrating an operational state in a second interval of a two-stage variable-displacement oil pump in accordance with a third embodiment of the present invention, FIG. 12 is a configuration diagram illustrating an operational state in a third interval of a two-stage variable-displacement oil pump in accordance with a third embodiment of the present invention, and FIG. 13 is a configuration diagram illustrating an operational state in a fourth interval of a two-stage variable-displacement oil pump in accordance with a third embodiment of the present invention.

As illustrated in FIGS. 10 to 13, a two-stage variable-displacement oil pump in accordance with a third embodiment of the present invention is configured to include a pumping part 100 and a path setting part 200.

The pumping part 100 is a part, in which pumping is carried out to discharge and deliver oil to a main gallery or the like, and is the same as the pumping part 100 of the first embodiment. Therefore, a detailed description thereof will not be provided.

The path setting part 200 is a part which allow the oil discharged from a discharge port 113 to be supplied to a regulating chamber 150 or to be returned to an oil tank, and is configured to include a 3/2-way valve 210 and a check valve 230 provided between the pumping part 100 and the main gallery.

The 3/2 way valve 210 is provided with: an intake port P into which the oil discharged from the discharge port 113 and circulated through the main gallery is introduced; a discharge port A for supplying the oil introduced into the intake port P to a downstream stage; and a tank port T for returning the oil introduced into the intake port P to the tank, and further provided with two flow passages which connect the intake port P with the discharge port A or connect the intake port P with the tank port T.

As described above, the operation of the two-stage variable-displacement oil pump configured to include the pumping part 100 and the path setting part 200 may be controlled by a control unit.

Specifically, the control unit may control the pumping part 100 and the path setting part 200 such that: the pressure of the oil increases in proportion to the rpm of the rotor 130 when the rpm of the rotor 130 is less than a first rpm; the pressure of the oil is maintained at a first pressure P1 in FIG. 14 when the rpm of the rotor 130 is greater than or equal to the first rpm and less than a second rpm; the pressure of the oil increases in proportion to the rpm of the rotor 130 when the rpm of the rotor 130 is greater than or equal to the second rpm and less than a third rpm; and the pressure of the oil is maintained at a second pressure P2 in FIG. 14 when the rpm of the rotor 130 is greater than or equal to the third rpm.

To this end, the control unit controls the intake port P and the discharge port A of the 3/2-way valve 210 to be connected when the rpm of the rotor 130 is less than the second rpm; controls the discharge port A and the tank port T of the 3/2-way valve 210 to be connected when the rpm of the rotor 130 is greater than or equal to the second rpm and less than the third rpm; and controls the intake port A and the tank port T of the 3/2-way valve 210 to be connected when the rpm of the rotor 130 is greater than or equal to the third rpm.

The above-mentioned control process of the control unit will be described for each interval as follows.

First, when the rpm of the rotor 130 is greater than or equal to zero and less than the first rpm point A in FIG. 14, the control unit controls the intake port P and the discharge port A of the 3/2-way valve 210 to be connected.

Accordingly, as illustrated in FIG. 10, the oil suctioned into the suction port 111 is compressed in a rotary chamber RS and discharged to the discharge port 113, and the oil discharged through the discharge port 113 is then circulated through an oil filter and the main gallery, then passes through the intake port P and the discharge port A of the 3/2-way valve, and may then be supplied to the regulating chamber 150.

In such a state, as illustrated in FIG. 14, the pressure of the oil increases in proportion to the rpm of the rotor 130 until the pressure in the rotary chamber RS reaches P1.

Next, when the rpm of the rotor 130 is greater than or equal to the first rpm and less than the second rpm point B in FIG. 14, the control unit controls the intake port P and the discharge port A of the 3/2-way valve 210 to be connected.

At this point, as the pressure of the oil applied to the regulating chamber 150 increases, the support spring 140 is compressed, and thus, the rotor 130 and the outer cam ring 120 become nearly concentric to each other, and the compression of the oil is not carried out. Therefore, the pressure of the oil does not increase and is maintained at the first pressure P1 in FIG. 14.

That is, as illustrated in FIG. 11, the oil suctioned into the suction port 111 is discharged to the discharge port 113 via a rotary chamber RS, the oil discharged through the discharge port 113 is then circulated through an oil filter and the main gallery, then passes through the intake port P and the discharge port A of the 3/2-way valve 210, and is then in a state of being supplied to the regulating chamber 150, and the oil pressure is maintained at the first pressure.

Next, when the rpm of the rotor 130 is greater than or equal to the second rpm and less than the third rpm point C in FIG. 14, the control unit controls the discharge port A and the tank port T of the 3/2-way valve 210 to be connected.

That is, while the oil in the regulating chamber 150 returns to the tank through the intake port P and the discharge port A of the 3/2-way valve 210, the oil pressure in the regulating chamber 150 is decreased, and thereby the rotor 130 and the outer cam ring 120 become eccentric to each other again.

Accordingly, as illustrated in FIG. 12, the oil suctioned from the suction port 111 is compressed in the rotary chamber RS and discharged to the discharge port 113, and the oil discharged through the discharge port 113 may be circulated through the oil filter and the main gallery.

In such a state, as illustrated in FIG. 14, the oil pressure increases in proportion to the rpm of the rotor 130 until the oil pressure in the rotary chamber RS reaches the second pressure.

Next, when the rpm of the rotor 130 is greater than or equal to the third rpm, the control unit controls the intake port P and the discharge port A of the 3/2-way valve 210 to be connected.

At this point, as the pressure of the oil applied to the regulating chamber 150 increases, the support spring 140 is compressed, and thus, the rotor 130 and the outer cam ring 120 become nearly concentric to each other and the compression of the oil is not carried out. Therefore, the pressure of the oil does not increase and is maintained at the second pressure P2 in FIG. 14.

That is, as illustrated in FIG. 13, the oil suctioned from the suction port 111 is discharged to the discharge port 113 through the rotary chamber RS, and the oil discharged through the discharge port 113 may be circulated through the oil filter and the main gallery. In addition, in this state, a portion of the oil is discharged through the discharge port 113 is introduced into the first port P1 of the spool valve 220 through a first separate line L1 and is then discharged through the second port P2 and supplied to the regulating chamber 150.

In such a state, the overall oil pressure is maintained at the second pressure.

Meanwhile, the check valve 230 provided between the pumping part 100 and the main gallery is a part for preventing an excessive increase in the oil pressure caused by an electrical malfunction of the 3/2-way valve 210, and functions to prevent the pressure of the oil circulated in the main gallery from increasing beyond a predetermined level even when the 3/2-way valve 210 does not normally operate.

As described above, the present invention is capable of performing two-stage adjustment of the pressure of oil discharged from an oil pump according to a rotation speed rpm of the oil pump, and therefore has a merit of being capable of supplying oil to meet the oil pressure required for a oil supplying portion.

In addition, a first port of a spool valve is connected to a line of oil before being circulated through a main gallery, so that space utilization may be improved within a limited space of a variable-displacement pump, the structure may be simplified, and costs may thereby be saved.

In addition, a path setting part is configured only from a 3/2-way valve, and the connection states between the ports of the 3/2-way valve are controlled through a control part, so that the number of parts may be reduced, and costs may thereby be saved.

Preferred exemplary embodiments of the present invention has been described so far with reference to drawings, but it is obvious that a person skilled in the art could make many various, obvious modifications from the description without departing from the scope of the present invention. Thus, the scope of the present invention should be interpreted according to claims set forth herein to include such various modifications.

What is claimed is:

1. A two-stage variable-displacement oil pump comprising:

a pumping part including:

a casing having a suction port for suctioning oil stored in an oil tank and a discharge port for discharging the oil suctioned into the suction port;

an outer cam ring disposed in the casing and being rotatable with respect to a pivot shaft in the casing;

a rotor disposed in the outer cam ring, configured to rotate in concert with a rotation of a driving shaft, and including a plurality of vanes on an outer circumferential surface thereof, the rotor being configured to be eccentric relative to the outer cam ring;

a support spring having one end contacting a spring support part formed on an outer side surface of the outer cam ring and another end contacting an inner side surface of the casing, the support spring elastically supporting the outer cam ring; and a single regulating chamber provided between the outer cam ring and the casing and configured to change a degree of an eccentricity of the outer cam ring; and a path setting part configured to set a circulating path of the oil so that the oil discharged from the discharge port is supplied to the single regulating chamber or returned to the oil tank, the path setting part comprising a 3/2-way valve including:

a valve intake port configured to receive the oil discharged from the discharge port of the casing;

a valve discharge port configured to supply the oil received through the valve intake port directly to the single regulating chamber; and a tank port configured to return the oil received through the valve intake port to the oil tank, wherein the 3/2-way valve is controlled to connect the valve intake port and the valve discharge port or connect the valve intake port and the tank port.

2. The two-stage variable-displacement oil pump of claim 1, further comprising:

a controller configured to control a pressure of the oil:

to increase in proportion to an rpm of the rotor when the rpm of the rotor is less than a first rpm;

to be maintained at a first pressure when the rpm of the rotor is greater than or equal to the first rpm and less than a second rpm;

to increase in proportion to the rpm of the rotor when the rpm of the rotor is greater than or equal to the second rpm and less than a third rpm; and to be maintained at a second pressure when the rpm of the rotor is greater than or equal to the third rpm.

3. The two-stage variable-displacement oil pump of claim 2, wherein the controller controls the valve intake port and the valve discharge port of the 3/2-way valve to be connected when the rpm of the rotor is less than the second rpm, and controls the valve discharge port and the tank port of the 3/2-way valve to be connected when the rpm of the rotor is greater than or equal to the second rpm and less than the third rpm.

4. A two-stage variable-displacement oil pump comprising:

a pumping part including:

a casing having a suction port for suctioning oil stored in an oil tank and a discharge port for discharging the oil suctioned into the suction port;

an outer cam ring disposed in the casing and being rotatable with respect to a pivot shaft in the casing;

a rotor disposed in the outer cam ring, configured to rotate in concert with a rotation of a driving shaft, and including a plurality of vanes on an outer circumferential surface thereof, the rotor being configured to be eccentric relative to the outer cam ring;

a support spring having one end contacting a spring support part formed on an outer side surface of the outer cam ring and another end contacting an inner side surface of the casing, the support spring elastically supporting the outer cam ring; and a single regulating chamber provided between the outer cam ring and the casing and configured to change a degree of an eccentricity of the outer cam ring; and a path setting part configured to set a circulating path of the oil so that the oil discharged from the discharge port is supplied to the single regulating chamber or returned to the oil tank, the path setting part comprising a spool valve including:

a first port configured to receive at least a part of the oil discharged from the discharge port;

a second port configured to supply the oil received through the first port to the single regulating chamber;

a third port connected to the discharge port; and a fourth port connected to the third port, the fourth port being configured to supply the oil received through the third port to the single regulating chamber, wherein the spool valve is configured to connect the first port and the second port or connect the third port and the fourth port according to a pressure of the oil received through the first port.

5. The two-stage variable-displacement oil pump of claim 4, further comprising:

a controller configured to control a pressure of the oil:

to increase in proportion to an rpm of the rotor when the rpm of the rotor is less than a first rpm;

to be maintained at a first pressure when the rpm of the rotor is greater than or equal to the first rpm and less than a second rpm;

to increase in proportion to the rpm of the rotor when the rpm of the rotor is greater than or equal to the second rpm and less than a third rpm; and to be maintained at a second pressure when the rpm of the rotor is greater than or equal to the third rpm.

6. The two-stage variable-displacement oil pump of claim 5, wherein the controller controls the valve intake port and the valve discharge port of the 3/2-way valve to be connected when the rpm of the rotor is less than the second rpm, and controls the valve discharge port and the tank port of the 3/2-way valve to be connected when the rpm of the rotor is greater than or equal to the second rpm and less than the third rpm.

7. The two-stage variable-displacement oil pump of claim 4, wherein the path setting part further comprises:

a 3/2-way valve including:

a valve intake port configured to receive the oil discharged from the discharge port of the casing;

a valve discharge port configured to supply the oil received through the valve intake port to the spool valve; and a tank port configured to return the oil received through the valve intake port to the oil tank, wherein the 3/2-way valve is controlled to connect the valve intake port and the valve discharge port or connect the valve intake port and the tank port.

8. The two-stage variable-displacement oil pump of claim 4, wherein the spool valve is controlled to operate to block a connection between the first port and the second port and to connect the third port and the fourth port when the rpm of the rotor is less than the third rpm, and to connect the first port and the second port and block a connection between the third port and the fourth port when the rpm of the rotor is greater than or equal to the third rpm.

* * * * *